United States Patent [19]

Tetenborg et al.

[11] 4,305,241

[45] Dec. 15, 1981

[54] METHOD AND APPARATUS FOR SUSPENDING LARGE SACKS FROM THE FILLING FUNNEL OF A SACK-FILLING APPARATUS

[75] Inventors: Konrad Tetenborg; Helmut Hüwelmann, both of Lengerich, Fed. Rep. of Germany

[73] Assignee: Windmoller & Holscher, Lengerich, Fed. Rep. of Germany

[21] Appl. No.: 37,347

[22] Filed: May 9, 1979

[30] Foreign Application Priority Data

May 16, 1978 [DE] Fed. Rep. of Germany ..... 2821273

[51] Int. Cl.[3] ..... B65B 43/28; B65B 43/30

[52] U.S. Cl. ..... 53/459; 53/573; 53/384

[58] Field of Search ..... 53/373, 573, 508, 571, 53/67, 384, 507, 69, 459, 570

[56] References Cited

U.S. PATENT DOCUMENTS

| | | | |
|---|---|---|---|
| 2,950,589 | 8/1960 | Litchard | 53/373 |
| 3,225,514 | 12/1965 | Inglett | 53/573 |
| 3,225,515 | 12/1965 | Inglett | 53/573 X |
| 3,440,432 | 4/1969 | Justis | 53/508 X |
| 3,509,689 | 5/1970 | Perrin | 53/571 |
| 3,945,173 | 3/1976 | Buzzi | 53/571 |
| 4,182,094 | 1/1980 | Lieder et al. | 53/67 |

*Primary Examiner*—Horace M. Culver

*Attorney, Agent, or Firm*—Fleit & Jacobson

[57] ABSTRACT

For automatically suspending large sacks successively from a filling device, each flattened sack is folded at least once onto itself. Every sack is in turn brought up to stops on a table and scanned for alignment by photocells. The mouth of the sack is pulled open by suckers, transferred to gripper mechanisms which are carried by swing arms and provided with hinged grippers cooperating with wedges inserted in the open mouth, and the sack is then swung from the table to the filling device where it is pushed onto a funnel.

9 Claims, 8 Drawing Figures

METHOD AND APPARATUS FOR SUSPENDING LARGE SACKS FROM THE FILLING FUNNEL OF A SACK-FILLING APPARATUS

The invention relates to a method of suspending large sacks from the filling funnel of a sack-filling apparatus, wherein the sack which as yet lies flat and is open at one end is engaged by a pivotable gripper and pushed thereby onto the filling funnel, as well as to an apparatus for performing this method.

DE-OS No. 26 47 432 discloses large sacks which are made from a tube section of a fabric of plastics threads or plastics tapes coated on the outside or laminated on the outside with plastics film, are intended to be suspended from the filling funnel of a sack-filling apparatus by the aforementioned method and, on account of their size and the strength of their material, are adapted to hold pourable material of a weight of 1 ton and higher.

In DE-OS No. 26 52 010 as well as the patent of addition thereto applied on Apr. 27, 1978, methods have been described by which such large sacks can be filled and closed fully automatically. According to the first step of these methods, the large sacks to be filled are engaged laterally at their open filling end and are opened by pulling the walls of the sack apart before the pourable material is filled into the initially freely suspended sack. The present invention concerns a method and apparatus with which, for the purpose of carrying out this first method step, the large sacks can be suspended in an advantageous manner from the filling funnels of sack-filling apparatuses.

By reason of their dimensions, large sacks are difficult to manipulate. Further, the number of the large sacks to be filled is not so large that it is viable to provide an automatic push-on device for suspending them from the filling funnel of a sack-filling apparatus. A method of the aforementioned kind for suspending sacks of conventional size to the filling funnel of a sack-filling apparatus is, for example, known from DE-OS No. 23 61 037. This known method, in which each sack to be filled is lifted from a stack by suckers and transferred into a vertical position from which it is taken by suckers secured to swing arms, opened thereby and pushed between the clamping jaws located at the filling funnel, is basically unsuitable for pushing on large sacks. On the other hand, it is of course desired to reduce as much as possible the manual work required for pushing on large sacks. One particular difficulty when pushing large sacks onto the filling funnel results from their length because the usual distance travelled by the grippers which push the sacks onto the filling funnel would not be sufficient for pulling the sacks off the support on which they have been placed in readiness prior to filling.

It is therefore the problem of the present invention to provide a method and apparatus in which large sacks placed ready on a support can be automatically and reliably pushed onto the filling funnel of sack-filling apparatuses.

According to the invention, this problem is solved in a method of the aforementioned kind in that the base end of the sack placed ready on the table is folded at least once onto itself. According to the method of the invention, the gripper engaging the ready-positioned sack at its open end and pushing it onto the filling funnel can pull the sack completely beyond the edge of the table without the need for the gripper travelling over an excessively long pivotal path, which would result in bulky apparatuses and the consequential higher investment costs and a larger space requirement.

Desirably, the base halves of the sack are folded over in the same direction about the centre line of the base onto an adjoining sack wall and the latter is subsequently folded at least once onto itself. The sack wall may be folded onto itself in zig-zag fashion beneath the folded-over base halves. This kind of folding permits the filling end of the large sack to be pushed under the folded-over base so that the large sack receives a handy and stackable form which permits its simple preparation for filling. In this case it is merely necessary to pull the filling end out from the folded-over base halves and to prepare the sack on the table with the lower region still folded so that the grippers can laterally engage the filling aperture. The sack prepared in the manner of the invention becomes unfolded to its full length only after the grippers have pulled it over the table edge.

An apparatus for performing the method of the invention comprising grippers which are pivotably mounted in the machine frame and transfer the margins of the filling aperture of the sack to clamping jaws provided on the filling funnel is characterised according to the invention in that the grippers consist of two wedges which move into the filling aperture of the sacks placed ready on a table fixed with respect to the frame and of which the wedge faces form clamping jaws disposed in the filling aperture and against which clamping jaws can be pressed that are secured to the ends of pivotable levers, and that the spacing of the grippers from each other is larger than the width of the filling funnel of which the lower part provided with the clamping jaws can be splayed apart for completely opening the sack.

Since the grippers feed the sack to the filling funnel with the filling aperture pre-opened in wedge shape, its efficient transfer will be ensured because the splayable filling funnel portions are likewise wedge-shaped in the closed condition.

Other advantageous embodiments of the invention have been described in more detail in the subsidiary claims.

One example of the invention will now be described in more detail with reference to the drawing, wherein.

Figure 8:
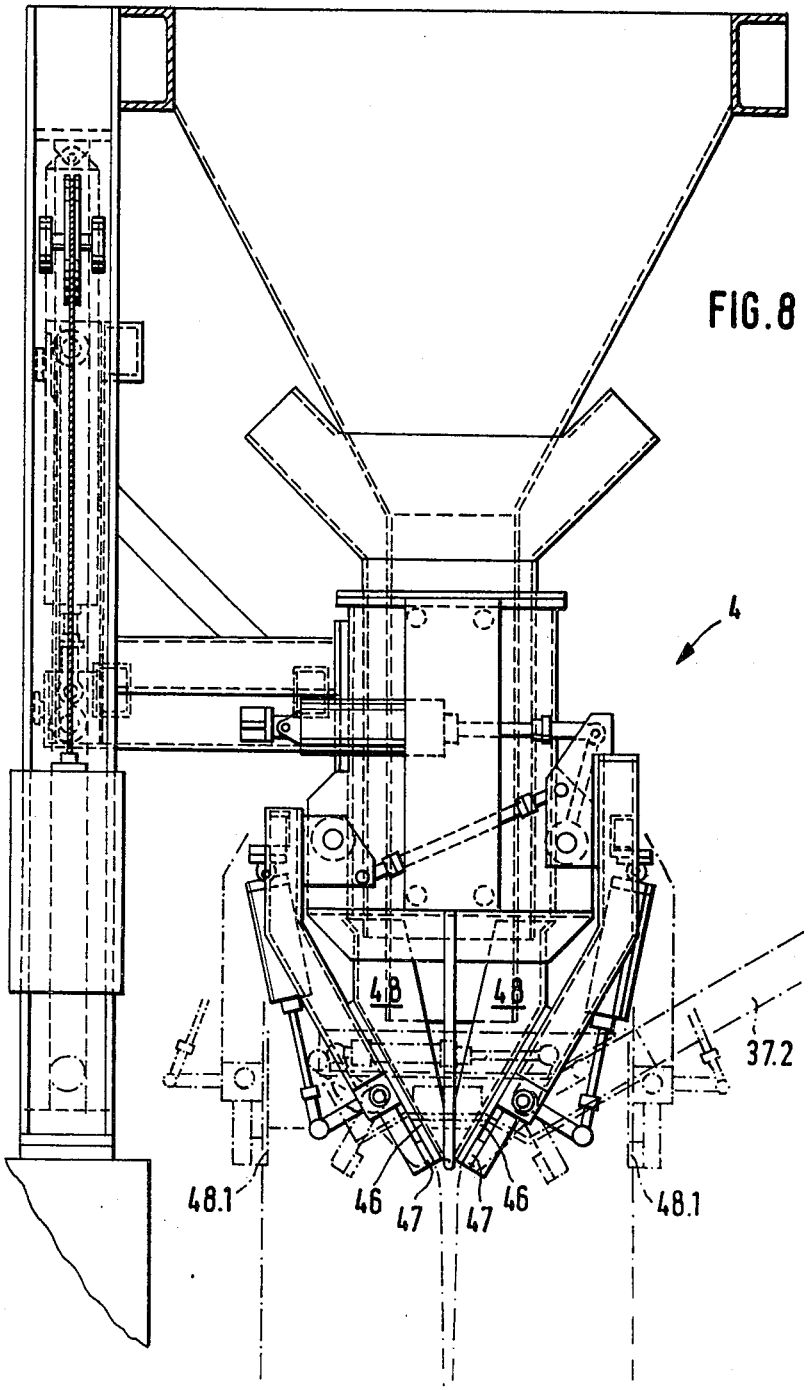
FIG. 8 is a side elevation of the filling funnel with the gripper unit indicated in chain-dotted lines.

A stack 2 of large sacks 3 is placed on a table 1 with its surface at about working height, ready for taking to a sack-filling apparatus 4 illustrated in FIG. 8. The bases 6 of the large sacks 3 are centrally folded onto themselves about a fold line 6.1. In addition, the walls of the sacks are folded onto themselves for a first time about a first fold line 7 and for a second time about a second fold line 8 so that the filling aperture 9 is disposed under the base 6 which has been folded onto itself. Adjacent the stack 2, a single large sack 3 is shown of which the filling aperture 9 has been pulled out from under the base 6 so that half of the sack wall extending up to the fold line 7 lies flat on the table 1. The filling aperture 9 has been pulled up to abutments 10 provided at the left-hand edge of the table.

Above the table 1 in the vicinity of the abutments 10 two photocells 11 are directed onto the surface of the table; they are darkened by the large sack 3 and one of them will show 'light' even when the sack 3 is only slightly laterally displaced because a corresponding mirror 11.1 let into the table 1 opposite the photocell 11 in question will no longer be obscured by the large sack 3. The photocells 11 are connected to an electric intermediate circuit (not shown) with which an illuminated indicator can be actuated to show the operator the wrong position of the large sack 3 and for blocking the supply means to be described hereinafter in the case of misalignment.

Two suckers 12 are also arranged in the surface of the table. Suckers 13 corresponding to the suckers 12 are movably mounted above the table 1. The suckers 12, 13 are connected to a source of suction air by means of controlled conduits (not shown). The suckers 13 are secured in square tubes 14 flanged to levers 15 which are secured to shafts 17 freely rotatable in supports 16. Also fixed to the shafts 17 there are levers 18 hinged by bars 19 to one end of levers 20 of which the other end is secured to a shaft 21 that is freely rotatable in the supports 16 for achieving synchronous motion of the levers 20 or 18. A lever 22 fixed to the shaft 21 has its free end pivoted to a piston rod of a piston-cylinder unit 23 of which the cylinder is pivoted to a plate 24 secured to the supports 16. By actuating the piston-cylinder unit 23, the suckers 13 can be swung from the position 13 shown in full lines to a position 13.1 shown in broken lines. In the position 13.1, the suckers 13 are applied to the filling end or upper sack wall of the large sack 3. By switching on the suction air and pivotal motion to the position 13, the filling end is opened because the lower sack wall is held by the suckers 12.

The supports 16 are interconnected by shafts 25, 26 on which levers 27, 28 and 29, 30 are freely rotatable. The other ends of the levers are secured to shafts 31, 32 which are mounted in the frame of the apparatus. A lever 33 which is also fixed to the shaft 31 has its free end hinged to a piston rod of a piston-cylinder unit 34 of which the cylinder is pivoted to the frame of the apparatus. On actuating the piston-cylinder unit 34, the suckers 13 can be swung up out of the position 13 to a position 13.2. This higher level of the suckers 13 is necessary to provide a free passage between the suckers 13 and the table 1 for the sack 3 when suspending it from the filling funnel.

Figure 1:
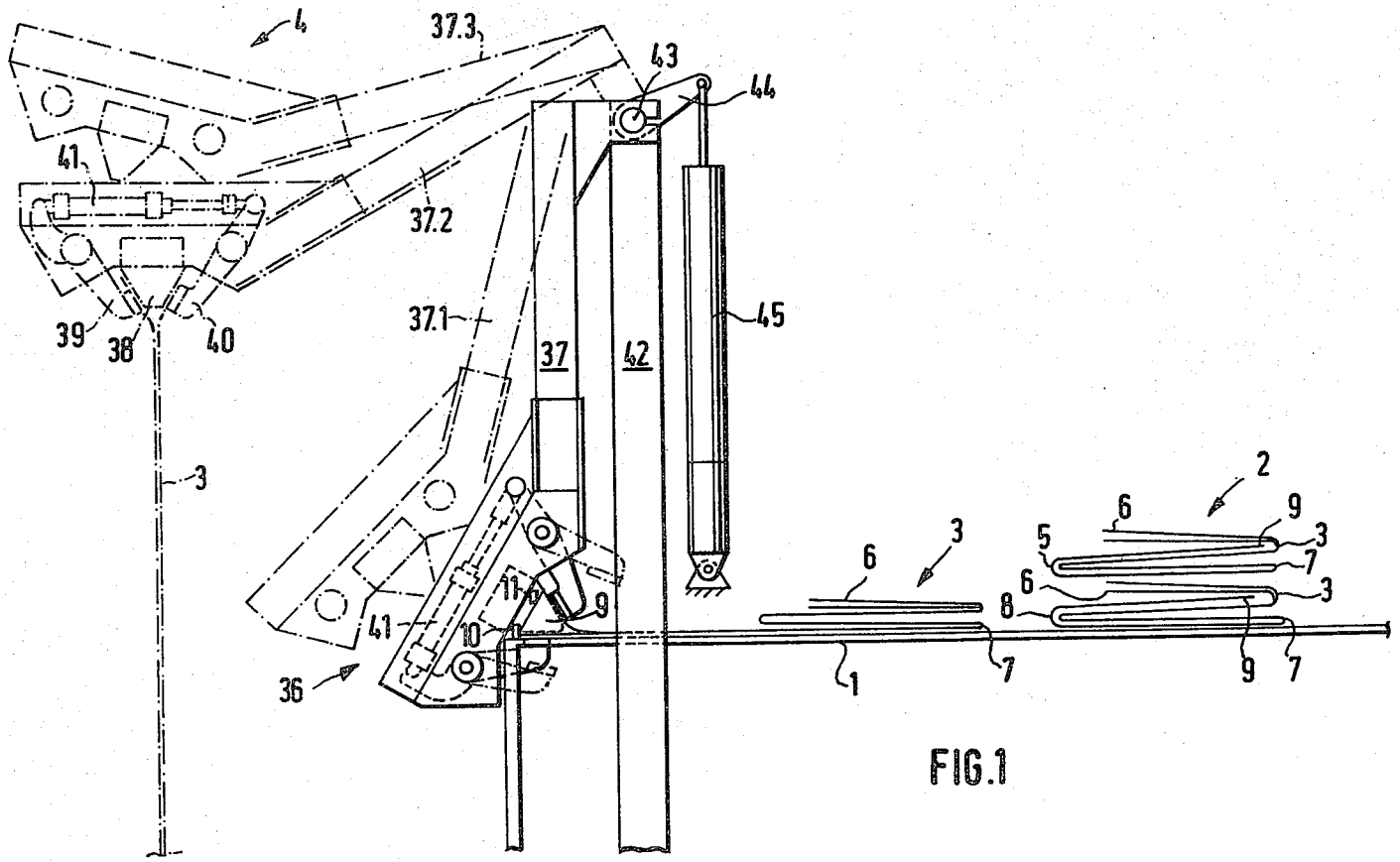
FIG. 1 is a side elevation of the grippers for pushing onto the filling funnel the large sacks which are placed ready on a table.
Figure 2:
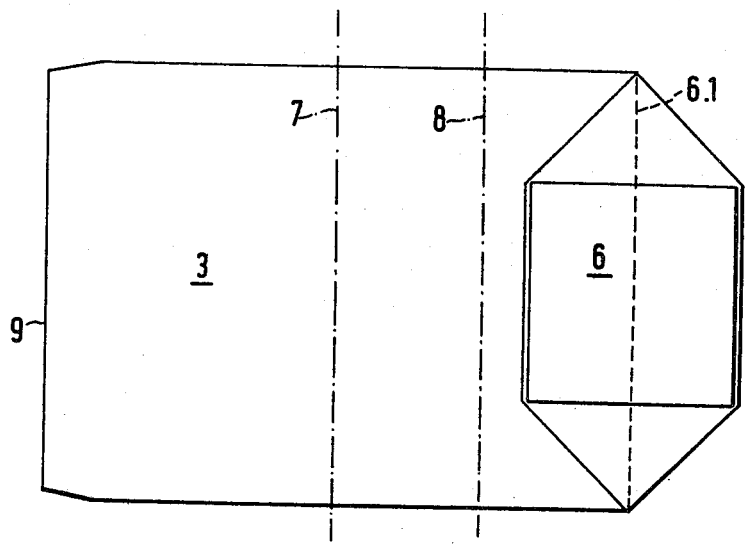
FIG. 2 is a plan view of a flattened large sack.
Figure 3:
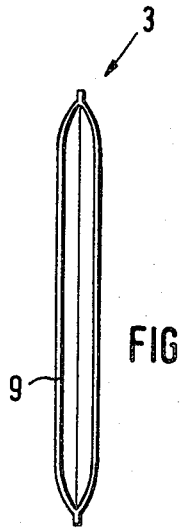
FIG. 3 is a front elevation of a large sack with the filling aperture pre-opened.
Figure 4:
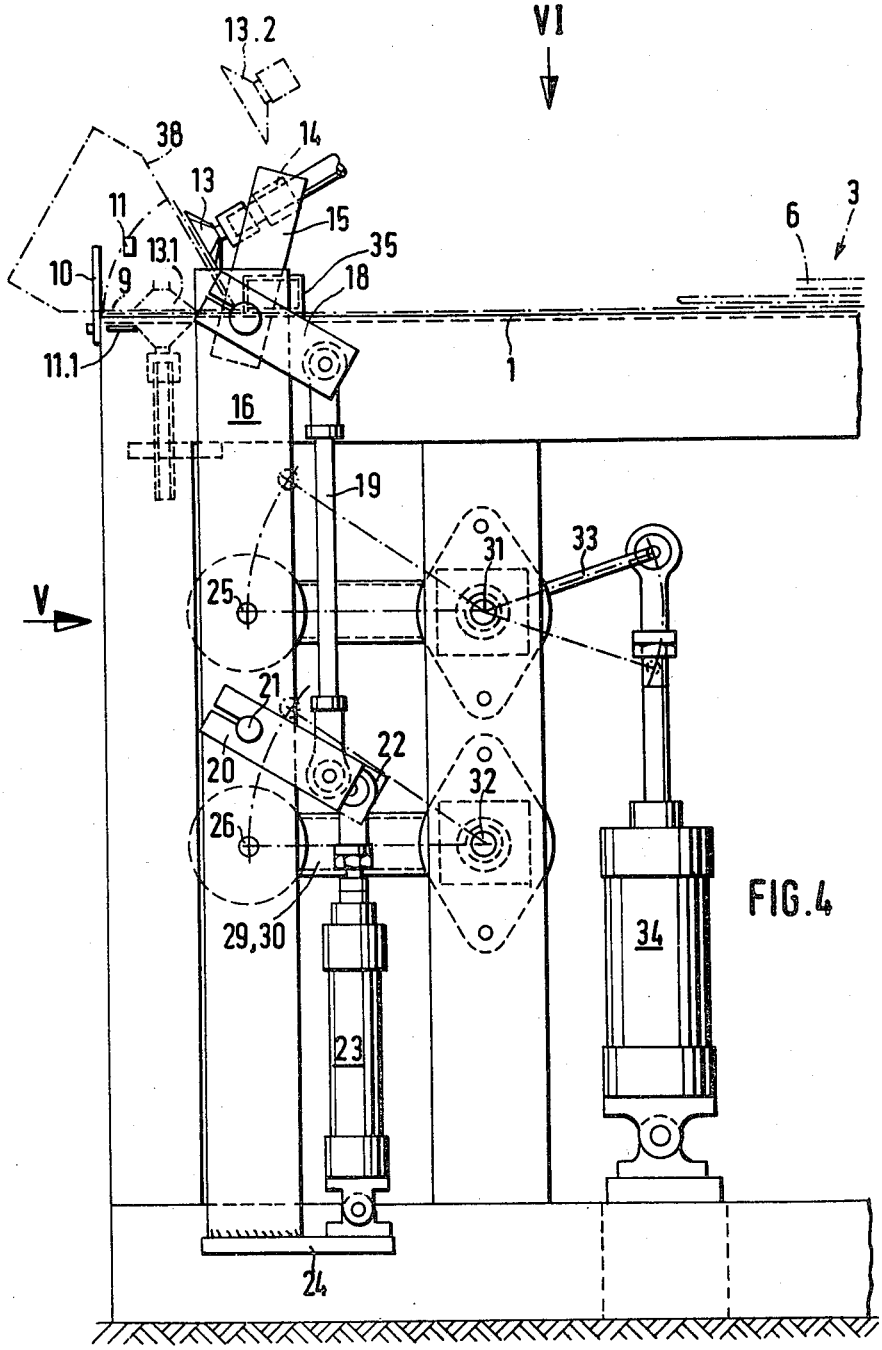
FIG. 4 is a side elevation of the table surface with suckers and holding down means and the associated controls.
Figure 5:
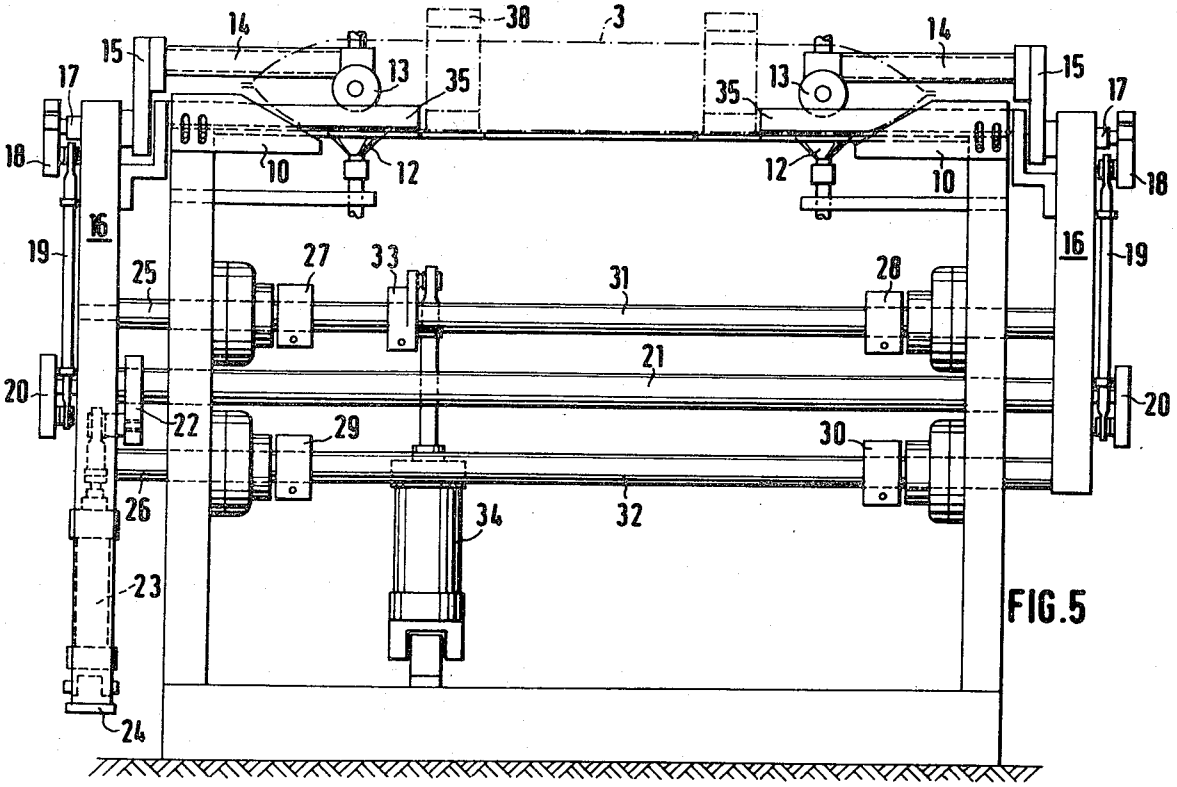
FIG. 5 is an elevation of the device in the direction of the arrow V in FIG. 4.
Figure 6:
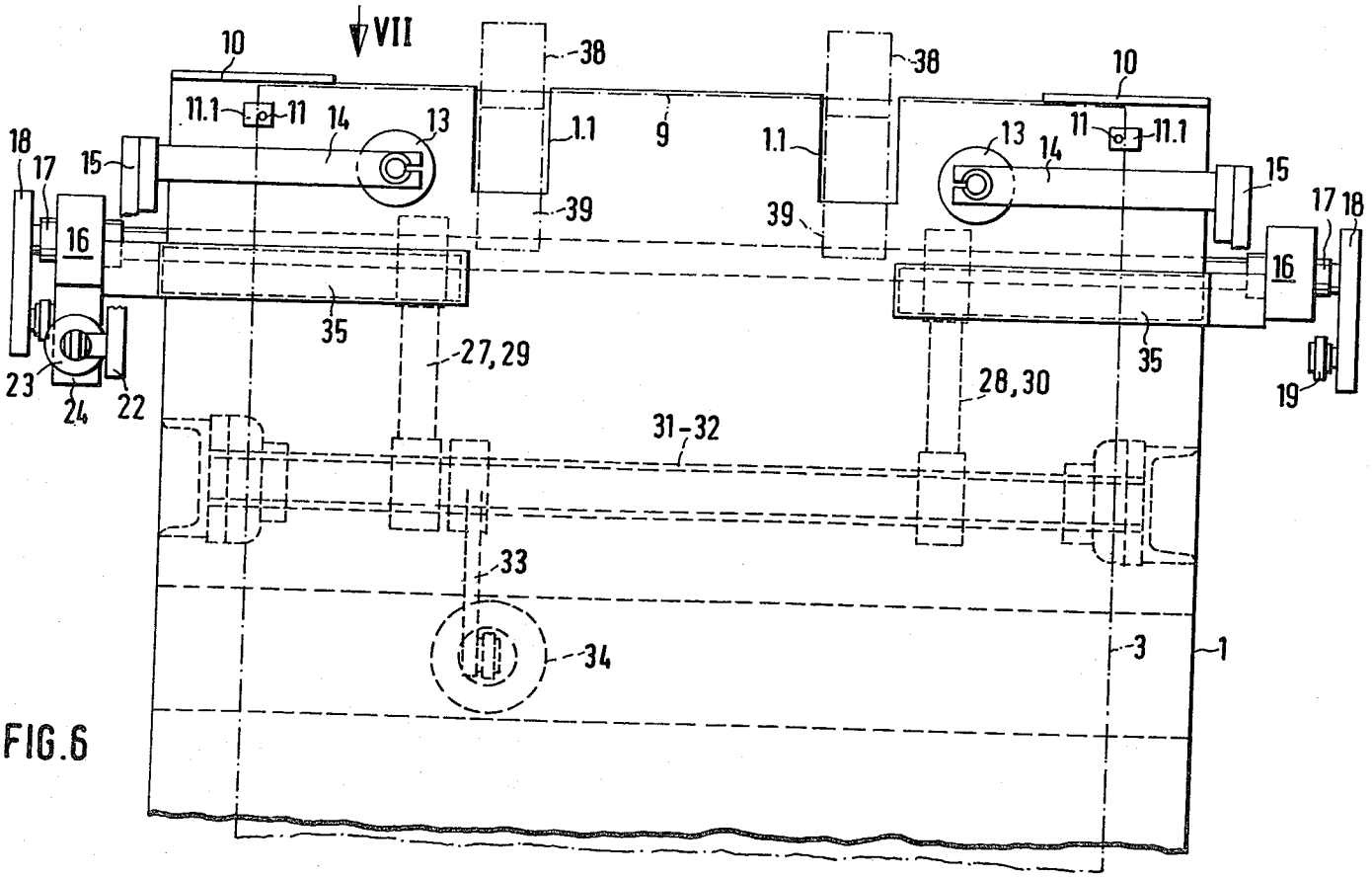
FIG. 6 is an elevation of the device in the direction of the arrow VI in FIG. 4.
Figure 7:
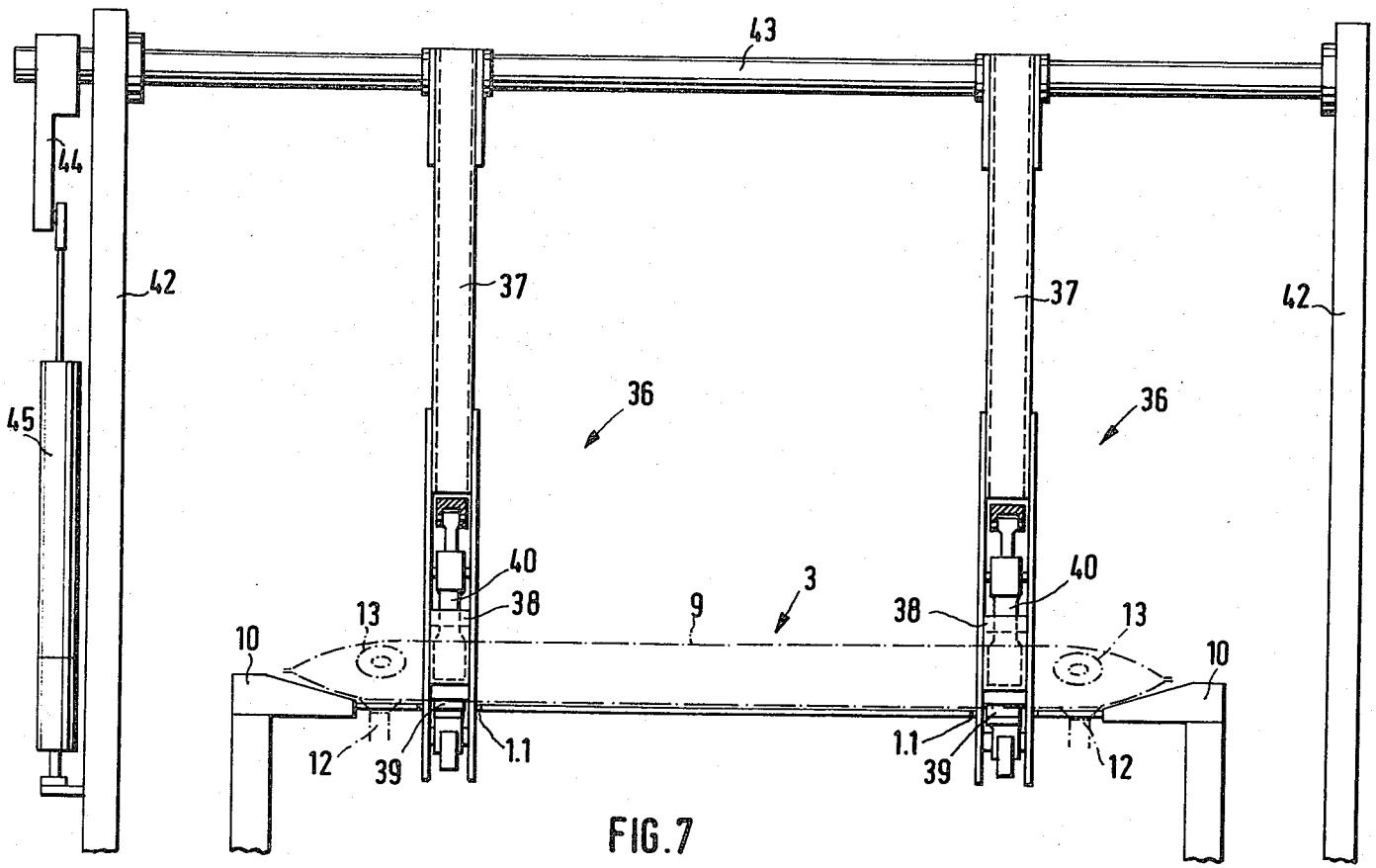
FIG. 7 is an elevation of the apparatus in the direction of the arrow VII in FIG. 6.

Fixed to the supports 16 there are holding-down means 35 which hold the large sack 3 on the table 1 so that an acute-angled opening is achieved at the filling aperture during opening by the suckers 12, 13, as is shown in FIGS. 1, 3 and 4.

On actuating the piston-cylinder unit 34, not only the suckers 13 are swung to the position 13.2 but the holding-down means 35 are also lifted off the large sack 3. In the left-hand edge of the table 1 between the abutments 10 there are two recesses 1.1 into which two gripper devices 36 move so that they can also engage from below the filling aperture 9 that has been opened by the suckers 12, 13.

Each gripper device 36 consists of an arm 37 to which there is secured an acute-angled wedge 38 which has the same angle as the filling aperture of the large sack 3 opened by the suckers 12, 13 and in which two grippers 39, 40 are pivotably mounted. The grippers 39, 40 are in the form of two-armed levers to the free arms of which a piston-cylinder unit 41 is pivoted. By means of the piston-cylinder unit 41, the grippers 39, 40 can be swung to and from the wedge 38. The arms 37 are secured to a shaft 43 which is freely rotatably mounted in the frame 42 and to which a lever 44 is screw-connected. A piston-cylinder unit 45 hinged to the lever 44 has its cylinder pivoted to the frame 42. By means of the piston-cylinder unit 45, the arms 37 can, apart from the position 37 shown in full lines, be swung to the positions 37.1, 37.2 and 37.3 shown in chain-dotted lines.

FIG. 8 illustrates a sack-filling apparatus 4 which is described in more detail in a patent application filed together with the present application and from which the large sack 3 is suspended by its filling aperture 9 when the arms 37 of the gripper devices 36 move to the position 37.2. The filling aperture 9 is pushed onto retaining plates 46 of filling funnel halves 47 which extend between the grippers 39, 40 or the wedges 38. Pressure bars 48 are pressed thereagainst to hold the large sack, so that the grippers 39, 40 can now be opened. They now swing to the position 37.3 so that the wedges 38 are retracted from the filling aperture 9. After the filling funnel halves 47 have been splayed to the filling position 48.1, the grippers 39, 40 swing down to the waiting position 37.1 from which the cycle can commence anew.

We claim:

1. A method of suspending large sacks from a filling funnel of a sack-filling apparatus, the sacks having closed base ends and open filling ends defining filling apertures, said method comprising:

folding the sack about a first fold line extending parallel to edges of the filling and base ends of the sack, the first fold line being centrally located between the filling and base ends;

folding the sack about a second fold line extending parallel to said first fold line and located centrally between the first fold line and the base end;

folding the base of the sack about a center line of the base so that ends of the folded base extend in the same direction and the folded base adjoins a portion of the sack wall located between the base end and first fold line;

positioning the folded sack on a table of a sack-filling apparatus with the filling end located in a predetermined position on the table;

engaging the filling end of the sack with movable grippers to open the filling end; and moving the gripper to unfold the folded sack and to place and push the sack onto a filling funnel; of the sack-filling apparatus.

2. A method according to claim 1, characterized in that engaging of the filling end of the folded sack is accomplished by two grippers having gripper arms that grip the folded sack at a filling aperture defined by its open end at lateral regions of the filling end, the method further comprising clamping the filling aperture to the filling funnel, margins of the filling aperture to be clamped to the filling funnel being pulled apart to such an extent that the gripper means are releasable from the sack and laterally swingable away from same.

3. A method according to claim 2 further comprising opening the filling aperture of the sack laid ready on the table to wedge shape, and introducing wedges cooperating with the gripping arms into the filling aperture.

4. An apparatus for suspending large sacks having a predetermined length from gripping jaws of a filling funnel of a sack-filling apparatus, the sacks having closed base ends and open filling ends defining filling apertures and being placed on a support surface in a folded condition, said apparatus comprising:

a machine frame;

a support surface fixed with respect to said frame for supporting folded sacks, said support surface being spaced from the filling funnel by a distance equal to approximately one half the predetermined length of the sack to be filled;

gripper means pivotably mounted in said frame for gripping side margins of end walls of a sack defining a filling aperture and for transferring the gripped side margins onto gripping jaws of a filling funnel; and means for pivotably moving said gripper means between a sack gripping position and a position transferring a gripped sack onto the filing funnel of the sack-filling apparatus, said gripper means unfolding a gripped sack during movement between the sack gripping position and the transferring position and comprising spaced apart wedges movable in said sack gripping position into a filling aperture of a folded sack placed on the support surface, first and second clamping jaw means movable towards and cooperating with respective ones of said wedges for clamping a sack, and means for controlling movement of said first and said second clamping jaw means so that portions of said jaw means are movable between sack clamping positions and positions wherein said portions of said jaw means are spaced from each other by a distance greater than the width of the filling aperture of the sack.

5. Apparatus according to claim 4, wherein said support surface has an end portion provided with recesses into which portions of the gripper means are movable to engage margins of a lower wall of the sack defining the filling aperture.

6. Apparatus according to claim 4 or claim 5, comprising first suckers disposed in a front region of the support surface which supports a lower sack wall, second suckers, and pivotable levers for supporting said second suckers for movement towards and away from said first suckers for contacting and lifting an upper wall of the sack defining the filling aperture away from the lower sack wall.

7. Apparatus according to claim 6, further comprising holding-down means lowerable onto the sack at a spacing behind the first suckers for producing a wedge-shaped aperture for the filling aperture.

8. Apparatus according to claim 4, further comprising abutments for aligning folded sacks to be filled positioned on a front edge of the support surface.

9. Apparatus according to claim 4 or 8, characterized in that photocells for indicating mispositioning of sacks are provided in a region of the front edge of the support surface.

* * * * *